US009261895B2

(12) United States Patent
Tsuguma

(10) Patent No.: US 9,261,895 B2
(45) Date of Patent: Feb. 16, 2016

(54) OPERATING PEDAL DEVICE FOR VEHICLE

(75) Inventor: Tomohiro Tsuguma, Toyota (JP)

(73) Assignee: Toyoda Iron Works Co., Ltd., Toyota-shi, Aichi (JP)

( * ) Notice: Subject to any disclaimer, the term of this patent is extended or adjusted under 35 U.S.C. 154(b) by 0 days.

(21) Appl. No.: 14/379,647

(22) PCT Filed: Aug. 16, 2012

(86) PCT No.: PCT/JP2012/070850

§ 371 (c)(1),
(2), (4) Date: Aug. 19, 2014

(87) PCT Pub. No.: WO2013/125071

PCT Pub. Date: Aug. 29, 2013

(65) Prior Publication Data

US 2015/0033902 A1 Feb. 5, 2015

(30) Foreign Application Priority Data

Feb. 21, 2012 (JP) ..... 2012-035522

(51) Int. Cl.
*G05G 1/44* (2008.04)
*G05G 1/50* (2008.04)

(52) U.S. Cl.
CPC ... *G05G 1/44* (2013.01); *G05G 1/50* (2013.01)

(58) Field of Classification Search
CPC ..... G05G 1/30; G05G 1/44
USPC ..... 74/512
See application file for complete search history.

(56) References Cited

U.S. PATENT DOCUMENTS

| | | | | |
|---|---|---|---|---|
| 5,074,163 | A * | 12/1991 | Baumann | 74/512 |
| 6,513,407 | B1 * | 2/2003 | Higgins | 74/560 |
| 2004/0020324 | A1 * | 2/2004 | Jemmeson et al. | 74/512 |
| 2010/0058887 | A1 | 3/2010 | Fujita et al. | |
| 2010/0180717 | A1 * | 7/2010 | Himetani | 74/560 |
| 2010/0307284 | A1 | 12/2010 | Himetani et al. | |

FOREIGN PATENT DOCUMENTS

| | | |
|---|---|---|
| JP | 11-115430 | 4/1999 |
| JP | 2003-112614 | 4/2003 |

(Continued)

OTHER PUBLICATIONS

Notification of Reason(s) for Rejection for Japanese Patent Appl. No. 2012-035522 dated Jun. 24, 2014.

*Primary Examiner* — Vicky Johnson
(74) *Attorney, Agent, or Firm* — Finnegan, Henderson, Farabow, Garrett & Dunner, LLP

(57) ABSTRACT

A vehicle operation pedal apparatus includes an elongate hollow pedal arm provided with a pedal sheet, the vehicle operation pedal apparatus transmits a pedal operating force applied to the hollow pedal arm to an output member connected to the hollow pedal arm. The hollow pedal arm is formed of a pair of a front half and a rear half each having a U-shaped section and combined with each other; the vehicle operation pedal apparatus comprises a plate-shaped connection plate having a connecting portion connected to the output member so as to be pivotable relative to the output member and fixed integrally with the hollow pedal arm; in the front half and the rear half, slit-shaped through-holes are formed, respectively; and the connection plate is passed through the hollow pedal arm in a vehicle front-rear direction through the through-holes.

7 Claims, 6 Drawing Sheets

(56) References Cited

FOREIGN PATENT DOCUMENTS

| | | |
|---|---|---|
| JP | 2009-181442 | 8/2009 |
| JP | 2010-247757 | 11/2010 |
| WO | WO 2008/120586 | 10/2008 |

* cited by examiner 12
16
18
20
24
32
32b
34
34b
34c
44
44h
46
52
54
W1
W3
III
IV
VEHICLE UPPER SIDE
VEHICLE REAR SIDE
VEHICLE RIGHT SIDE
VEHICLE FRONT SIDE

OPERATING PEDAL DEVICE FOR VEHICLE

CROSS-REFERENCE TO RELATED APPLICATIONS

This application is a national phase application of International Application No. PCT/JP2012/070850, filed Aug. 16, 2012, and claims the priority of Japanese Application No. 2012-035522, filed Feb. 21, 2012, the content of both of which is incorporated herein by reference.

TECHNICAL FIELD

The invention relates generally to a vehicle operation pedal apparatus, and more specifically to an improvement of a vehicle operation pedal apparatus in which a pair of halves each having a U-shape section are joined together to form a hollow pedal arm.

BACKGROUND ART

There has been known a vehicle operation pedal apparatus that includes an elongate hollow pedal arm disposed in an up-down direction of a vehicle and provided with a pedal sheet that is disposed at a lower end portion of the pedal arm and that is depressed toward a vehicle front side, the vehicle operation pedal apparatus transmitting a pedal operating force applied to the hollow pedal arm to an output member that is connected to the hollow pedal arm so as to be pivotable relative to the hollow pedal arm. An example of such an apparatus is described in Patent Document 1. A hollow pedal arm is formed of a pair of halves each having a U-shape (a shallow U-shape with angled corners or a dish shape) section that is obtained by splitting the hollow pedal arm into two in the vehicle-width direction. The halves are combined with each other so that opening sides thereof face each other, and side end portions of the halves, which are located on respective sides in the vehicle front-rear direction, are integrally joined together to form a hollow tubular shape. Further, a connection hole is formed in each of the paired halves, and a connection pin is disposed to pass through both of the connection holes, so that a connection link or a push rod, which is the output member, is connected so as to be relatively pivotable about an axis (connection axis) of the connection pin.

PRIOR ART DOCUMENT

Patent Document

Patent Document 1: Japanese Patent Application Publication No. 2009-181442

SUMMARY OF THE INVENTION

However, in a vehicle operation pedal apparatus having a structure in which a hollow pedal arm is split into two in the vehicle-width direction as described above, joined portions are located on the respective sides in the vehicle front-rear direction, and the joined portion on a rear side with respect to the vehicle is seen from a driver's seat side. This makes the hollow pedal arm look unattractive, and causes a possibility that, if a foot or a hand touches the joined portion by mistake, the foot or the hand will be injured.

On the other hand, a technique in which the above-described hollow pedal arm is split into two in the vehicle front-rear direction, and side end portions located on respective sides in the vehicle-width direction are integrally joined together to form a hollow tubular shape may be adoptable although the technique is not known. FIG. 7 is a sectional view illustrating a hollow pedal arm 100, which is one example of the above technique, the sectional view obtained by cutting the hollow pedal arm 100 in a direction perpendicular to its longitudinal direction. The hollow pedal arm 100 is formed of a pair of a front half 32 and a rear half 34 each having a U-shape section, and side end portions 32*a*, 34*a*, and side end portions 32*b*, 34*b* that are located on respective sides in the vehicle-width direction are integrally joined together by welding, respectively. In this case, when connection holes 102*a*, 102*b*, into which a clevis pin 30 for connecting an output member is inserted, are formed in joined portions of the pair of the halves 32, 34, deterioration of strength of the hollow pedal arm 100 may be caused. Thus, the connection holes are formed in, for example, side wall portions of the front half 32, but a front-rear dimension L becomes large, which may increase weight and increase manufacturing cost. Further, it is necessary to form the pair of the connection holes 102*a*, 102*b* concentrically with a high degree of accuracy, and hence as illustrated in, for example, FIG. 8, the connection holes are preferably simultaneously processed with the use of a draw back-mold press in which a pair of punches 104*a*, 104*b* are disposed to face each other. However, it is necessary to dispose a pair of dies 106*a*, 106*b* and a discharge passage 110, through which a scrap 108 drops, inside a pair of side walls of the front half 32, and hence a width dimension D becomes large, which also increases the weight and increase the cost. When the output member is connected with the use of a bifurcated clevis, it is not possible to use a general-purpose clevis due to an increase in the width dimension D, and there is also a possibility that the manufacturing cost will further increase.

The invention is made in light of the above-described circumstances, and an object of the invention is to make it possible to configure a compact, light and inexpensive hollow pedal arm without restricting flexibility in design regarding the front-rear dimension L and the width dimension D and to suppress deterioration of the appearance and occurrence of injury due to the joined portions, in a vehicle operation pedal apparatus in which the hollow pedal arm is formed by joining a pair of halves together.

Means for Solving the Problem

To achieve the object, the first aspect of the invention provides a vehicle operation pedal apparatus that includes an elongate hollow pedal arm disposed in an up-down direction of a vehicle and provided with a pedal sheet that is disposed at a lower end portion of the hollow pedal arm and that is depressed toward a vehicle front side, the vehicle operation pedal apparatus transmitting a pedal operating force applied to the hollow pedal arm to an output member that is connected to the hollow pedal arm so as to be pivotable relative to the hollow pedal arm, characterized in that: (a) the hollow pedal arm is formed of a pair of a front half and a rear half each having a U-shaped section, which are two members split along an up-down longitudinal direction and located respectively on front and rear sides with respect to the vehicle, and the halves are combined with each other so that opening sides face each other to join side end portions located on respective sides in a vehicle-width direction, thereby forming a hollow tubular shape; and (b) the vehicle operation pedal apparatus comprises a plate-shaped connection plate having a connecting portion connected to the output member so as to be pivotable relative to the output member and fixed integrally with the hollow pedal arm.

The second aspect of the invention provides the vehicle operation pedal apparatus recited in the first aspect of the invention, wherein the hollow pedal arm is obtained by combining the rear half and the front half with each other such that a pair of side end portions of the rear half are overlapped with and joined to outer sides of a pair of side end portions of the front half respectively.

The third aspect of the invention provides the vehicle operation pedal apparatus recited in the first or second aspect of the invention, wherein (a) in the front half and the rear half; a slit-shaped first through-hole and a slit-shaped second through-hole are formed, respectively; and (b) the connection plate is passed through the hollow pedal arm in a vehicle front-rear direction through the first through-hole and the second through-hole, and both end portions of the connection plate including the connecting portion projecting outwardly from the hollow pedal arm are fixed integrally with the hollow pedal arm by welding, respectively.

The fourth aspect of the invention provides the vehicle operation pedal apparatus recited in the first or second aspect of the invention, wherein (a) the connection plate is partially inserted into a slit-shaped first through-hole formed in the front half and fixed integrally with the hollow pedal arm by welding in a state where the connecting portion is projected from the first through-hole toward the vehicle front side; and (b) a pressing load for pushing the output member toward the vehicle front side is applied by the pedal operating force to the output member connected to the connection plate.

The fifth aspect of the invention provides the vehicle operation pedal apparatus recited in the fourth aspect of the invention, wherein (a) a slit-shaped second through-hole corresponding to the first through-hole is formed in the rear half; and (b) the connection plate is passed through the hollow pedal arm in the vehicle front-rear direction through the first through-hole and the second through-hole, and both end portions of the connection plate including the connecting portion projecting outwardly from the hollow pedal arm are fixed integrally with the hollow pedal arm by welding, respectively. The fifth aspect of the invention is one embodiment of the fourth aspect of the invention, but is also substantially one embodiment of the third aspect of the invention.

The sixth aspect of the invention provides the vehicle operation pedal apparatus recited in the fifth aspect of the invention, wherein a projection projecting in a longitudinal direction of the second through-hole is formed at a portion of the connection plate, which is located in a hollow of the hollow pedal arm.

The seventh aspect of the invention provides the vehicle operation pedal apparatus recited in the fifth aspect of the invention, wherein a projection projecting in a longitudinal direction of the first through-hole is formed at a portion of the connecting portion of the connection plate, which projects outwardly from the first through-hole.

Effect of the Invention

In the vehicle operation pedal apparatus in the present embodiment, the hollow pedal arm is formed of the pair of the front half and the rear half that are two members split in the vehicle front-rear direction, and the halves are combined with each other so that the opening sides face each other, to fixedly join the side end portions that are located on the respective sides in the vehicle-width direction, respectively, thereby forming a hollow tubular shape. Therefore, the joined portion is not easily seen from the driver's seat side, so that appearance of the hollow arm pedal is enhanced, and a foot or the like is inhibited from being injured by the joined portion. Further, the output member is connected to the connecting portion of the connection plate fixed integrally with the hollow pedal arm. Therefore, as compared with a case where connection holes are formed respectively in side portions of the hollow pedal arm to receive a connection pin or the like, flexibility in design regarding a front-rear dimension L or a width dimension D is not restricted, but it is possible to obtain a compact, light and inexpensive hollow pedal arm while ensuring a prescribed connection strength.

In the second aspect of the invention, since the hollow pedal arm is obtained by combining the rear half and the front half with each other such that a pair of side end portions of the rear half are overlapped with and joined to outer sides of a pair of side end portions of the front half, respectively, the joined portions are less likely to be seen from the driver's seat side, to further enhance the appearance and further effectively inhibit the foot or the like from being injured.

In the third aspect of the invention, since in the front half and the rear half a slit-shaped first through-hole and a slit-shaped second through-hole are formed, respectively; and the connection plate is passed through the hollow pedal arm in a vehicle front-rear direction through the first through-hole and the second through-hole, and both end portions of the connection plate including the connecting portion projecting outwardly from the hollow pedal arm are fixed integrally with the hollow pedal arm by welding, respectively, the connection plate can be firmly fixed to the hollow pedal arm. Further, two portions of the connection plate are positioned by the first through-hole and the second through-hole. This stabilizes an attaching posture of the connection plate with respect to the hollow pedal arm, and facilitates an attaching work (the welding). In addition, it is possible to set, as needed, a position where the connection plate is disposed, by changing positions of the first through-hole and the second through-hole, and it is possible to easily apply the invention to a vehicle having a different lever ratio of the hollow pedal arm or a different offset amount of the hollow pedal arm in the vehicle-width direction. Further, it is possible to commonly use the connection plate for multiple kinds of hollow pedal arms, and it is possible to further reduce the cost.

In the fourth aspect of the invention, since the connection plate is partially inserted into a first through-hole formed in the front half; and fixed integrally with the hollow pedal arm by welding in a state where the connecting portion is projected from the first through-hole toward the vehicle front side, it is possible to set, as needed, a position where the connection plate is disposed, by changing a position of the first through-hole, and it is possible to easily apply the invention to a vehicle having a different lever ratio of the hollow pedal arm or a different offset amount of the hollow pedal arm in the vehicle-width direction. Further, it is possible to commonly use the connection plate for multiple kinds of hollow pedal arms, and it is possible further reduce the cost.

In the fifth aspect of the invention, since a second through-hole corresponding to the first through-hole is formed in the rear half; and the connection plate is passed through the hollow pedal arm in the vehicle front-rear direction through the first through-hole and the second through-hole, and both end portions of the connection plate including the connecting portion projecting outwardly from the hollow pedal arm are fixed integrally with the hollow pedal arm by welding, respectively, the connection plate can be firmly fixed to the hollow pedal arm. Further, two portions of the connection plate are positioned by the first through-hole and the second through-hole. This stabilizes an attaching posture of the connection plate with respect to the hollow pedal arm, and facilitates an attaching work (the welding).

In the sixth aspect of the invention, since a projection projecting in a longitudinal direction of the second through-hole is formed at a portion of the connection plate, which is located in a hollow of the hollow pedal arm, even when welding which fixes the connection plate to the hollow pedal arm is peeled off, the projections abut against the inner wall surface of the rear half at positions in the vicinity of end portions of the second through-hole in the longitudinal direction, to prevent the connection plate from coming out of the second through-hole, so that the pedal operating force is transmitted to the output member via the connection plate.

In the seventh aspect of the invention, since a projection projecting in a longitudinal direction of the first through-hole is formed at a portion of the connecting portion of the connection plate, which projects outwardly from the first through-hole, even when welding which fixes the connection plate to the hollow pedal arm is peeled off, the projections abut against the outer wall surface of the front half at positions in the vicinity of end portions of the first through-hole in the longitudinal direction, to prevent the connection plate from being hidden in the first through-hole, so that the pedal operating force is transmitted to the output member via the connection plate.

MODES FOR CARRYING OUT THE INVENTION

Figure 1:
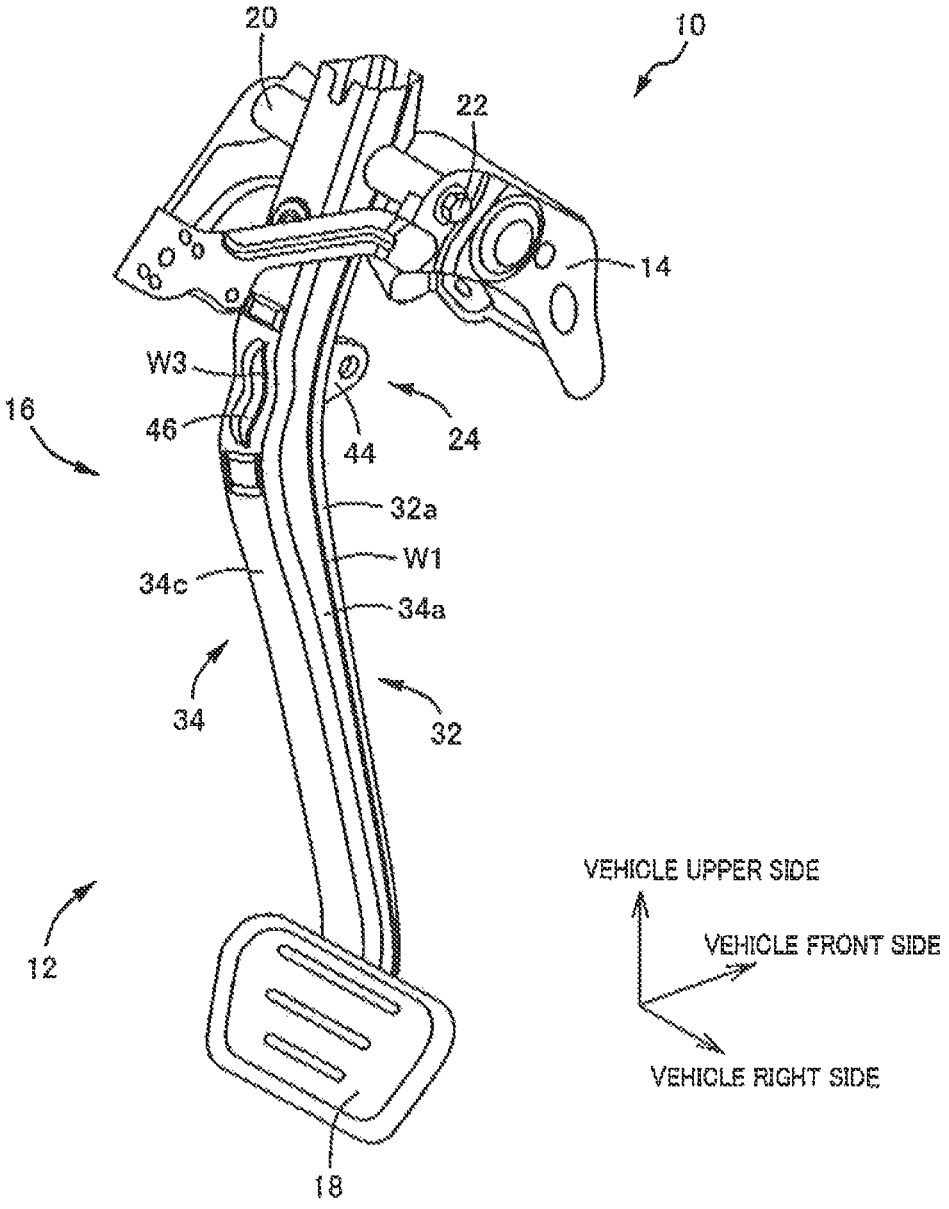
FIG. 1 is a perspective view illustrating a vehicle operation pedal apparatus that is one embodiment of the present invention.

The invention is suitably applied to a vehicle operation pedal apparatus for a service brake or a parking brake to which a relatively large pedal operating force is applied, but is also applicable to an accelerator pedal apparatus, a clutch pedal apparatus or the like. The hollow pedal arm is disposed in the up-down direction of the vehicle, but need not be in a completely vertical state, and may be tilted in the front-rear direction. For example, generally, the hollow pedal arm is disposed in such a posture that the lower end portion provided with the pedal sheet tilts toward the driver's seat (toward the vehicle rear side), and the hollow pedal arm is supported at an upper end portion so as to be movable about a support axis substantially parallel to the vehicle-width direction. Further, the hollow pedal arm need not be linearly extended, and may be bent in the vehicle front-rear direction or the right-left direction. That is, shape of the hollow pedal arm is not particularly limited as long as the hollow pedal arm contains a component in the up-down direction as a whole.

The hollow pedal arm is formed of the pair of the front and rear halves each having a U-shaped section, which are two members split along the up-down longitudinal direction and located respectively on the front and rear sides with respect to the vehicle. The U-shaped section may be an angled U-shape (U-shape with angled corners), a semicircular shape or a semielliptical shape, or a hat sectional shape having an outwardly bent brim-shaped flange located at a side end edge on an opening side. Further, the halves are combined with each other so that the opening sides face each other, and the side end portions located on the respective sides in the vehicle-width direction are fixed integrally with each other. However, for example, the side end portions of both of the halves may be overlapped with each other, and may be joined together by welding means such as are welding or another joining means such as an adhesive. Further, the side end edges on the opening sides may be brought into contact with each other and joined together by the arc welding or the like. In the case of a hat sectional shape, the flanges may mechanically be joined together by clinch processing, swaging processing or the like. That is, various joining configurations may be adopted. The joining is preferably continuously performed in the longitudinal direction of the hollow pedal arm, but may intermittently be performed. As each of the pair of the halves, a plate material (a steel plate or the like) made of a weldable metal is suitably used, and preferably formed into a U-shape in section by press working.

The connection plate is fixed integrally with the hollow pedal arm. The output member is connected via the connection pin or the like to the connection plate so as to be pivotable relative to the connection plate about the connection axis parallel to, for example, the support axis. The output member is, for example, a push rod of a brake booster, a connection link that connects an intermediate lever to the hollow pedal arm, a reaction force member of a simulation device which applies a reaction force to an operation pedal to electrically detect a pedal operating force, or the like. The connection plate is disposed at, for example, an intermediate portion between the support axis of the hollow pedal arm and the pedal sheet so that the connecting portion projects toward the front side of the vehicle, that is, in the depressing direction of the hollow pedal arm, and is configured to press the output member connected via the connection pin or the like to the connection plate toward the vehicle front side, but may be configured to pull the output member in accordance with a pedal operation. The position where the connection plate is disposed is determined as needed. In the fourth invention to the seventh invention, a pressing load is applied to the output member in accordance with the pedal operation. When a tensile load is applied, the connecting portion is projected toward the vehicle rear side from, for example, the second through-hole formed in the rear half and projections formed on the connection plate are projected from a portion located on an inner side of the second through-hole or an outer side of the first through-hole so that the connection plate does not come out of the second through-hole. Note that, the connection plate may be disposed above the support axis of the hollow pedal arm in the vehicle.

The connection plate is formed into, for example, a flat plate shape located in a single plane. However, when the connection plate is partially inserted into a slit-shaped through-hole formed in the hollow pedal arm in the vehicle up-down direction (direction perpendicular to the support axis) and the connecting portion is projected outwardly from the through-hole, a portion of the connection plate which projects from the through-hole may be bent in a crank form, or the connection plate may be bent into an L-shape and welded to be fixed to a front wall portion or a rear wall portion of the hollow pedal arm. That is, various configurations may be adopted. For example, the connecting portion of the connection plate is flatly formed to be located in a flat surface perpendicular to the support axis of the hollow pedal arm, and the connection hole is formed in parallel with the support axis, so that the output member is connected via the connection pin to the connection plate so as to be rotatable relative to the connection plate. As the connection plate, a plate material (a steel plate or the like) made of a weldable metal is also suitably used, and is fixed integrally with the hollow pedal arm by welding means such as the arc welding, but may be fixed thereto by another fixing means such as a screw or an adhesive.

In the second invention, the halves are combined with each other so that the pair of the side end portions of the rear half are overlapped with the outer sides of the pair of the side end portions of the front half. When the other inventions are carried out, the halves may be combined with each other so that the pair of the side end portions of the rear half are overlapped with inner sides of the pair of the side end portions of the front half, or so that one of the side end portions is overlapped with the inner side and the other side end portion is overlapped with the outer side. The side end portions are joined together by welding such as the are welding. However, when the connection plate is a weldable metal material, it is possible to simultaneously and continuously weld the connection plate to the hollow pedal arm. This enhances productivity and further reduces the manufacturing cost.

In the fourth invention, the connection plate is fixed by the welding in a state where the connection plate is partially inserted into the slit-shaped first through-hole formed in the front half. However, when the other inventions are carried out, no through-holes may be formed in the halves, but the connection plate may be fixed integrally with an outer wall surface of the hollow pedal arm by the are welding or the like. In the fifth invention, the slit-shaped second through-hole corresponding to the above first through-hole is formed in the rear half, and the connection plate is passed through both the first through-hole and the second through-hole. However, in the fourth invention, no second through-hole may be formed in the rear half but the connection plate may be fixed to the hollow pedal arm, for example, in a state where the connection plate is made in contact with the inner wall surface of the rear half. When the connection plate is passed through both the first through-hole and the second through-hole as in the fifth invention, the connection plate may be inserted from any one of the first through-hole side and the second through-hole side, or the connection plate may be interposed between the front half and the rear half before the halves are integrally joined together, and the pair of the halves may be joined in a state where the respective end portions of the connection plate are projected outwardly from the first through-hole and the second through-hole, respectively. When the through-hole used to attach the connection plate is formed in only one of the halves, in a state where the connection plate is disposed on one of the halves so that the connecting portion projects from the through-hole, the other half may be combined with the one half and integrally joined with the one half. Note that, in any case, the pair of the halves may be joined together to constitute the hollow pedal arm, and then the connection plate may be inserted from the first through-hole or the second through-hole and welded to the hollow pedal arm.

In the sixth invention, the projection is formed at the portion of the connection plate which is located in the hollow of the hollow pedal arm, so that even when the welding is peeled off the projection abuts against the vicinity of the end portion of the second through-hole in the longitudinal direction, to prevent the connection plate from coming out of the second through-hole. However, when the other inventions are carried out, such a projection is not necessary. The projection is preferably formed at a portion as close as possible to the second through-hole, and may be formed so as to come into contact with, for example, a rear wall portion of the rear half. However, the position of the projection is not particularly limited as long as the projection is formed at at least a portion located in the hollow of the hollow pedal arm. Further, the projections are preferably formed at respective end portions in the longitudinal direction of the second through-hole, that is, respective side portions of the connection plate. However, the projection may be formed at one of the side portions. A projecting dimension of each projection is appropriately determined so that the connection plate does not come out of the second through-hole, and is set in accordance with, for example, a clearance dimension between the second through-hole and the connection plate. Specifically, the projecting dimension of each of the projections on both sides is preferably larger than the clearance dimension. The projection in the seventh invention is different from the projection in the sixth invention in that the projection is formed in a portion of the connecting portion of the connection plate, which projects outwardly from the first through-hole. However, the position where the projection is formed and the projecting dimension are appropriately determined in the same manner as in the projection in the sixth invention.

Embodiment

Hereinafter, an embodiment of the invention will be described in detail with reference to the drawings.

Figures 2A, 2B, 2C:
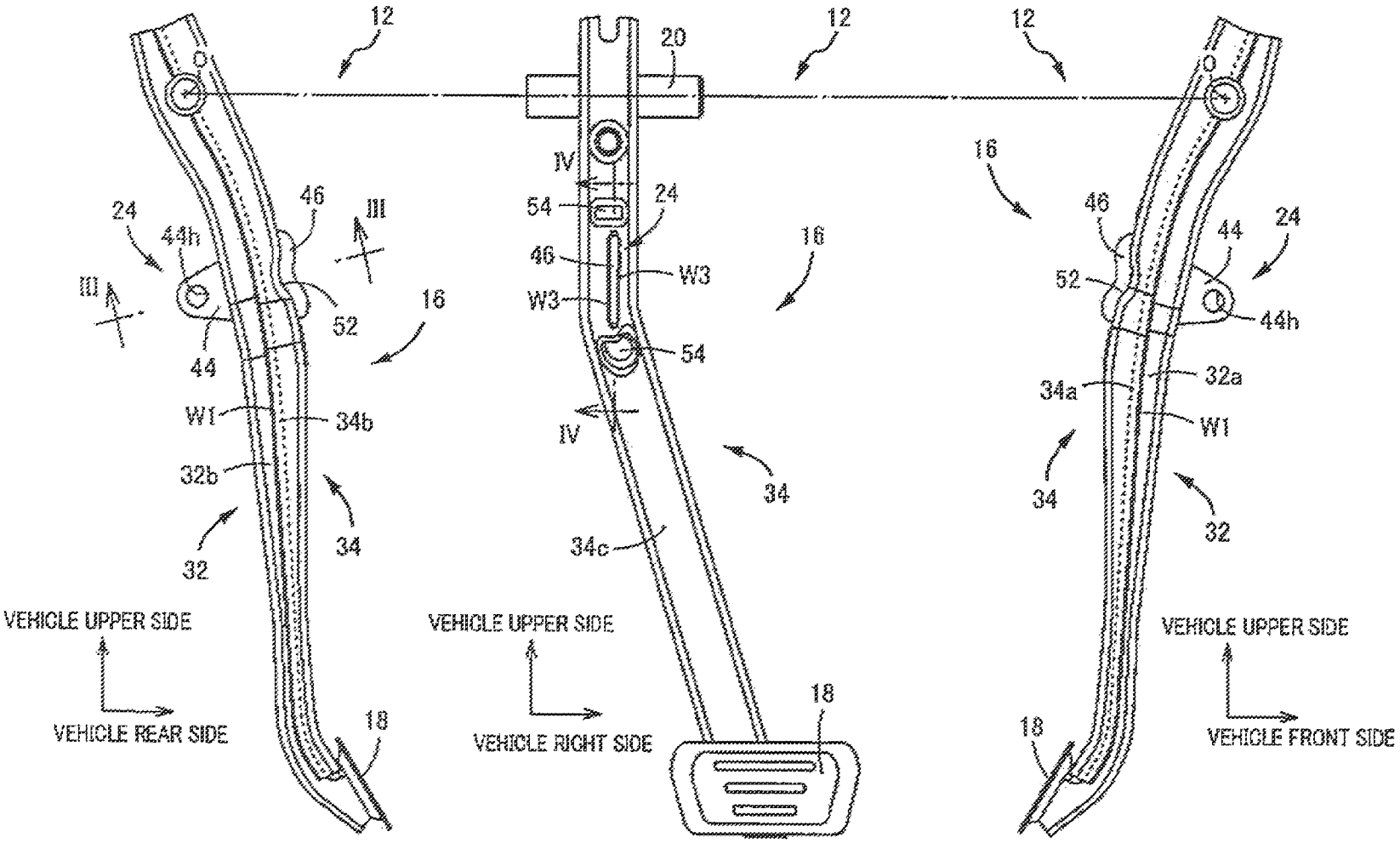
FIG. 2 is an explanatory view of the vehicle operation pedal apparatus of FIG. 1, in which FIG. 2(*a*) is a left side view, FIG. 2(*b*) is a front view as seen from a driver's seat side, and FIG. 2(*c*) is a right side view.
Figure 3:
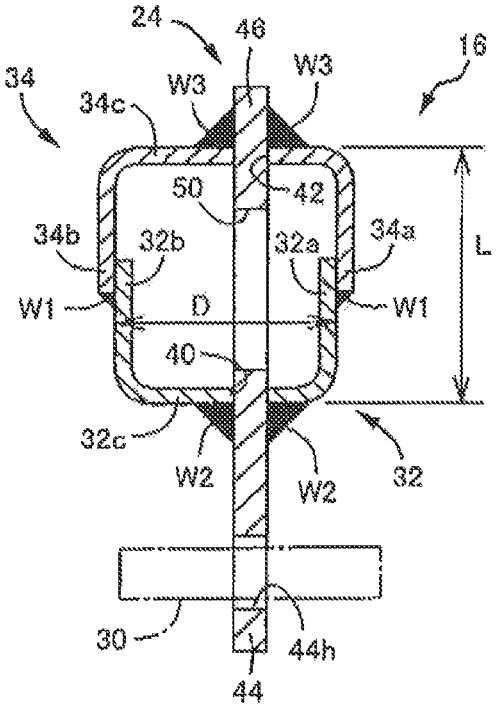
FIG. 3 is an enlarged sectional view taken along the line III-III in FIG. 2.
Figure 4:
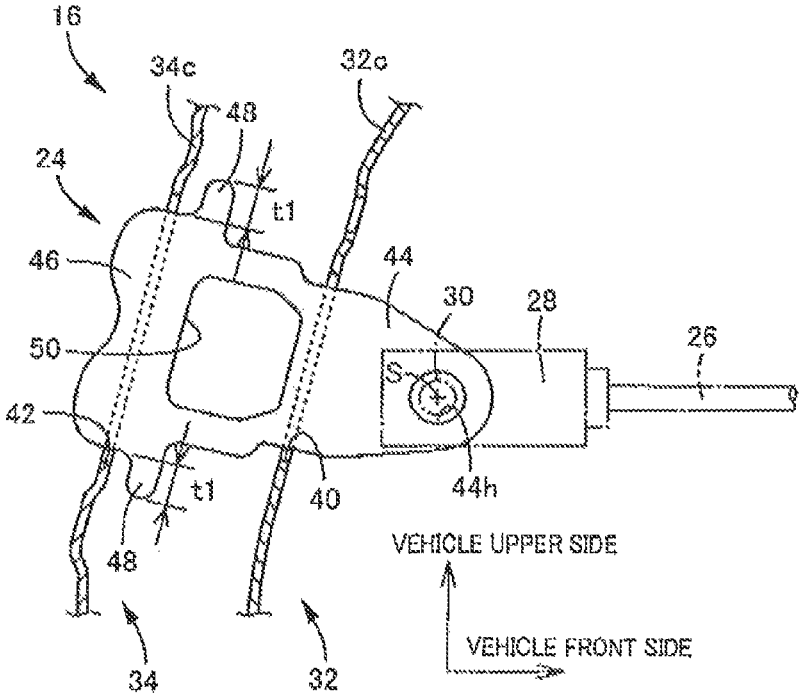
FIG. 4 is an enlarged sectional view taken along the line IV-IV in FIG. 2.

FIG. 1 is a perspective view illustrating a vehicle operation pedal apparatus 10 to which the invention is applied. The vehicle operation pedal apparatus is a brake pedal apparatus for a service brake, and an operation pedal 12 is movably disposed on a bracket 14 fixedly fitted to a vehicle body. FIG. 2 is an explanatory view of the operation pedal 12, in which FIG. 2(*a*) is a left side view, FIG. 2(*b*) is a front view as seen from a driver's seat side, and FIG. 2(*c*) is a right side view. Further, FIG. 3 is an enlarged sectional view taken along the line III-III in FIG. 2(*a*), and FIG. 4 is an enlarged sectional view taken along the line IV-IV in FIG. 2(*b*).

The operation pedal 12 includes an elongate hollow pedal arm 16 disposed in the up-down direction of a vehicle, and a pedal sheet 18 fixed to a lower end portion of the hollow pedal arm 16 and depressed by a driver. The hollow pedal arm 16 is disposed in such a posture that the lower end portion provided with the pedal sheet 18 tilts to the driver's seat side, that is, a vehicle rear side, and a cylindrical collar 20 is fixedly fitted to an upper end portion of the hollow pedal arm 16 to pass through the upper end portion in the vehicle-width direction. Further, the hollow pedal arm 16 is supported pivotably about an axis O of a support shaft 22, by the support shaft 22 disposed in the bracket 14 so as to pass through the collar 20. The axis O of the support shaft 22 is a support axis. Note that, each of FIG. 1 and FIG. 2 illustrates a state where the operation pedal 12 is at an initial position before the operation pedal 12 is depressed.

A connection plate 24 is fixed integrally with an intermediate portion of the hollow pedal arm 16, that is, a portion below the collar 20 and above the center in the up-down direction, so as to project toward a vehicle front side. As illustrated in FIG. 4, an output member 26 is connected to the connection plate 24 so as to be pivotable relative to the connection plate 24 about a connection axis S parallel to the support axis O, via a bifurcated (U-shaped) clevis 28 and a clevis pin 30. A pedal operating force applied to the operation pedal 12 is transmitted from the connection plate 24 to the output member 26 via the clevis pin 30, so that the output member 26 is pressed toward the vehicle front side. The output member 26 is, for example, a push rod of a brake booster, which is pressed toward the vehicle front side to generate a braking force corresponding to the pedal operating force. The connection axis S is the axis of the clevis pin 30, and the clevis pin 30 corresponds to a connection pin.

Figure 5A:
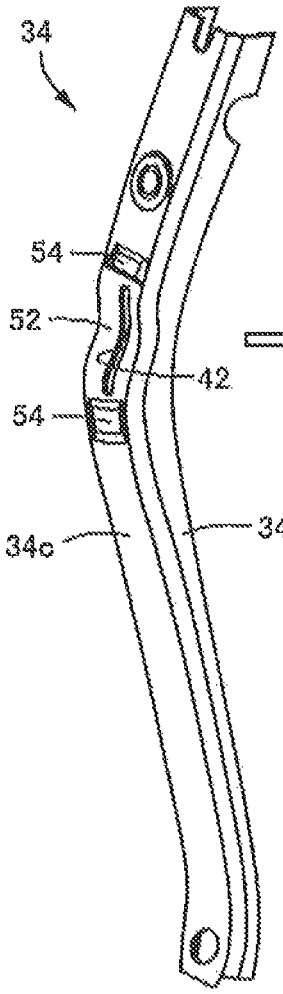
FIG. 5 is a perspective view illustrating a pair of a front half and a rear half forming a hollow pedal arm of the vehicle operation pedal apparatus of FIG. 1, which have not been jointed to each other, together with the connection plate.
Figure 5C:
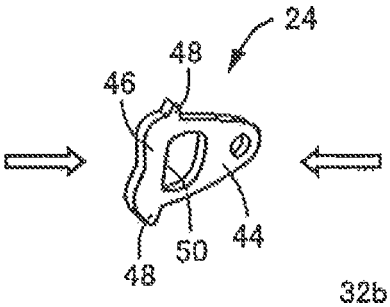
Figure 5B:
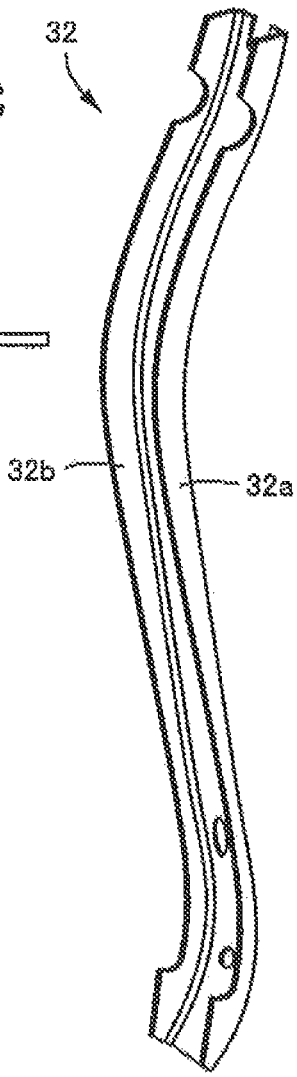

The hollow pedal arm 16 is formed of a pair of a front half 32 and a rear half 34, which are two members split along the up-down longitudinal direction and located on the front and rear sides with respect to the vehicle. FIG. 5 is a perspective view illustrating the pair of the front half 32 and the rear half 34 which have not been jointed to each other, together with the connection plate 24. Each of the halves 32, 34 is obtained by bending a weldable metal plate material such as a steel plate with the use of a press, and a section of each of the halves 32, 34 has a U-shape with angled corners. Further, the halves 32, 34 are combined with each other in such a posture that opening sides of the U-shapes face each other, and side end portions 32*a*, 34*a*, and side end portions 32*b*, 34*b* that are located on respective sides in the vehicle-width direction are integrally joined together by welding, respectively, to form a hollow rectangular tubular shape (a right-angle quadrangular shape) with a closed section. In the present embodiment, as it is apparent from FIG. 3, the halves 32, 34 are combined with each other so that a pair of side end portions 34*a*, 34*b* of the rear half 34 is overlapped with outer sides of a pair of side end portions 32*a*, 32*b* of the front half 32, respectively, and fillet welding is continuously applied in the longitudinal direction along end edges of the side end portions 34*a*, 34*b* by welding means such as arc welding, so that the paired halves 32, 34 are integrally joined together to constitute the hollow pedal arm 16. A first welding portion W1 in FIG. 1, FIG. 2 and FIG. 3 is a welding portion between the side end portions 32*a*, 34*a*, or a welding portion between the side end portions 32*b*, 34*b*.

The connection plate 24 is made of a weldable metal plate material such as a flat steel plate having a thickness larger than that of the half 32, 34, to ensure a prescribed strength so that it is possible to transmit the pedal operating force. In a front wall portion 32*c* of the front half 32 and a rear wall portion 34*c* of the rear half 34, a slit-shaped first through-hole 40 and a slit-shaped second through-hole 42 are formed linearly in a direction perpendicular to the support axis O, that is, in the up-down direction, respectively. Further, the connection plate 24 is disposed to pass through both the first through-hole 40 and the second through-hole 42 so as to extend through the hollow pedal arm 16 in the vehicle front-rear direction. Further, the fillet welding is applied to both end portions of the connection plate 24, which project outwardly from the hollow pedal arm 16 in the vehicle front-rear direction, by welding means such as the arc welding, so that the connection plate 24 is fixed integrally with the front half 32 and the rear half 34. Each of the first through-hole 40 and the second through-hole 42 is formed to have a width dimension substantially equal to the plate thickness of the connection plate 24, and has a length dimension slightly larger than a width dimension of the connection plate 24. Second welding portions W2 in FIG. 3 are welding portions between the connection plate 24 and the front half 32. Third welding portions W3 in FIG. 1, FIG. 2 and FIG. 3 are welding portions between the connection plate 24 and the rear half 34.

The connection plate 24 has a flat plate shape so that the whole connection plate 24 is located in a single plane, and is passed through the first through-hole 40 and the second through-hole 42, so that the connection plate 24 is fixed to the hollow pedal arm 16 in such a posture as to be located in the one plane substantially perpendicular to the support axis O. The second through-hole 42 is formed to correspond to the first through-hole 40 so that the connection plate 24 is disposed in the one plane substantially perpendicular to the support axis O as described above, and a position of the first through-hole 40 is determined as needed in accordance with a lever ratio of the operation pedal 12 or an offset amount of the pedal 12 in the vehicle-width direction, which are set for each vehicle. Further, the connection plate 24 has a connecting portion 44 projecting outwardly from the first through-hole 40, and a projecting portion 46 projecting outwardly from the second through-hole 42, and the connecting portion 44 has a connection hole 44*h* through which the clevis pin 30 is passed via a bearing or the like. On a base end side of the projecting portion 46, that is, in a portion located in the hollow of the hollow pedal arm 16 and close to the rear wall portion 34*c* of the rear half 34, there is formed a pair of projections 48 projecting to opposite sides in the longitudinal direction of the second through-hole 42. A projecting dimension t1 of each of the projections 48 is larger than a clearance dimension between the second through-hole 42 and the projecting portion 46 (the length dimension of the second through-hole 42—a width dimension of the projecting portion 46). Therefore, even when both the second welding portion W2 and the third welding portion W3 are peeled off, the projections 48 are brought into contact with an inner wall surface of the rear wall portion 34*c* to prevent the connection plate 24 from coming out of the second through-hole 42, so that the pedal operating force is reliably transmitted to the output member 26 via the connection plate 24. The projections 48 may be formed so as to come into contact with the rear wall portion 34*c* of the rear half 34 in a state where the connection plate 24 is fixed to the hollow pedal arm 16.

As illustrated in, for example, FIG. 5, the connection plate 24 is interposed between the front half 32 and the rear half 34 before the halves are integrally joined together, and the connecting portion 44 is fitted into the first through-hole 40 from inside of the front half 32, and the projecting portion 46 is fitted into the second through-hole 42 from inside of the rear half 34. Further, in this state, the halves 32, 34 are combined with each other so that the side end portions 32*a*, 32*b* of the front half 32 and the side end portions 34*a*, 34*b* of the rear half 34 are overlapped each other, and the side end portions 32*a*, 34*a* and the side end portions 32*b*, 34*b* are welded by welding means such as the arc welding. Further, the connecting portion 44 and the projecting portion 46 of the connection plate 24 are continuously welded to the front wall portion 32*c* of the front half 32 and the rear wall portion 34*c* of the rear half 34, respectively. Thus, the hollow pedal arm 16 to which the connection plate 24 is integrally fixed by welding is obtained, and the collar 20 and the pedal sheet 18 are further integrally fixed to the hollow pedal arm 16 by the welding or the like to obtain the operation pedal 12.

Note that, in the connection plate 24, a through-hole 50 is formed in a central portion located in the hollow pedal arm 16 and apart from the second welding portion W2 and the third welding portion W3, to achieve weight reduction while maintaining the prescribed strength. Further, in the hollow pedal arm 16, an intermediate portion in the longitudinal direction, which is provided with the connection plate 24, is smoothly curved to bulge toward the vehicle rear side as a whole, but a recessed portion 52 deformed to be inwardly dented is formed in an intermediate portion of the rear half 34, that is, a portion to which the connection plate 24 is fixed. Further, projected portions 54 partially deformed to be projected toward the outside (the vehicle rear side) are formed above and below the recessed portion 52 by draw processing or the like, so that a prescribed strength is ensured while the weight reduction by decreasing the thickness is maintained.

In the vehicle operation pedal apparatus 10 in the present embodiment, the hollow pedal arm 16 is formed of the pair of the front half 32 and the rear half 34 that are two members split in the vehicle front-rear direction, and the halves 32, 34 are combined with each other so that the opening sides face each other, to fixedly join the side end portions 32*a*, 34*a*, and the side end portions 32*b*, 34*b* that are located on the respective sides in the vehicle-width direction, respectively, thereby forming a hollow tubular shape. Therefore, the joined portion (the first welding portion W1) is not easily seen from the driver's seat side, so that appearance of the hollow arm pedal 16 is enhanced, and a foot or the like is inhibited from being injured by the joined portion.

Figure 7:
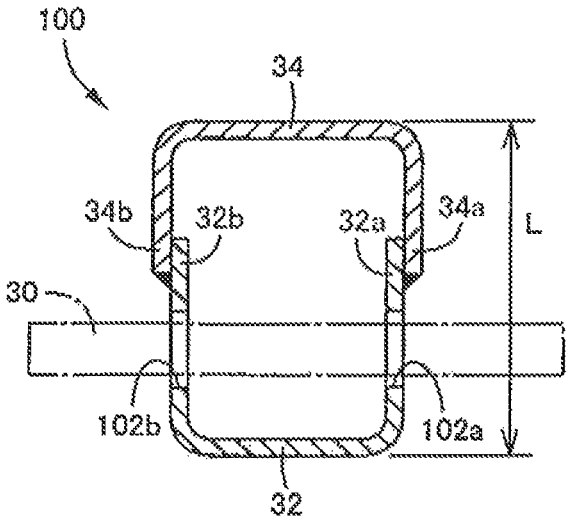
FIG. 7 is an explanatory view of the background art (unknown) of the present invention, and is a cross sectional view corresponding to FIG. 3.
Figure 8:
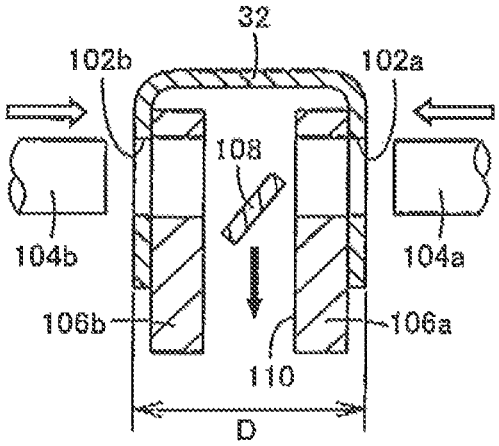
FIG. 8 is a cross sectional view for explaining a processing method when connection holes are processed in a pair of side walls of the front half regarding the background art of FIG. 7.

Further, the output member 26 is connected to the connecting portion 44 of the connection plate 24 fixed integrally with the hollow pedal arm 16. Therefore, as compared with a case where connection holes 102*b*, 102*a* are formed respectively in right and left side portions to receive the clevis pin 30 as in a hollow pedal arm 100 in FIG. 7, flexibility in design regarding a front-rear dimension L or a width dimension D is not restricted, but it is possible to obtain a compact, light and inexpensive hollow pedal arm 16 while ensuring a prescribed connection strength.

Further, the halves 32, 34 are combined with each other so that the pair of the side end portions 34*a*, 34*b* of the rear half 34 are overlapped with the outer sides of the pair of side end portions 32*a*, 32*b* of the front half 32, respectively, and the side end portions 32*a*, 34*a*, and the side end portions 32*b*, 34*b* are integrally joined together by the fillet welding, respectively, so that the joined portions are less likely to be seen from the driver's seat side, to further enhance the appearance and further effectively inhibit the foot or the like from being injured.

Further, the front half 32 and the rear half 34 are joined together by the welding, and hence it is possible to simultaneously and continuously fix the connection plate 24 to the hollow pedal arm 16 by the welding, so that it is possible to enhance productivity and further reduce manufacturing cost.

Further, the connection plate 24 is passed through the hollow pedal arm 16 in the vehicle front-rear direction through the first through-hole 40 formed in the front half 32 and the second through-hole 42 formed in the rear half 34, and is fixed integrally with the hollow pedal arm 16 by the welding in a state where the connecting portion 44 is projected from the first through-hole 40 toward the vehicle front side. Therefore, it is possible to set, as needed, a position where the connection plate 24 is disposed, by changing positions of the first through-hole 40 and the second through-hole 42, and it is possible to easily apply the invention to a vehicle having a different lever ratio of the hollow pedal arm 16 or a different offset amount of the hollow pedal arm 16 in the vehicle-width direction. Further, it is possible to commonly use the connection plate 24 for multiple kinds of hollow pedal arms 16, and it is possible further reduce the cost.

Further, as to the connection plate 24, the connecting portion 44 projecting outwardly from the first through-hole 40 and the projecting portion 46 projecting outwardly from the second through-hole 42 are fixed integrally with the front half 32 and the rear half 34 by the fillet welding, respectively. Therefore, the connection plate 24 is firmly fixed to the hollow pedal arm 16, and two portions of the connection plate 24 are positioned by the first through-hole 40 and the second through-hole 42. This stabilizes an attaching posture of the connection plate 24 with respect to the hollow pedal arm 16, and facilitates an attaching work (the welding).

Further, at the portion of the connection plate 24, which is located in the hollow of the hollow pedal arm 16, there are formed the projections 48 projecting in the longitudinal direction of the second through-hole 42. Even when both the second welding portion W2 and the third welding portion W3 which fix the connection plate 24 to the hollow pedal arm 16 are peeled off the projections 48 abut against the inner wall surface of the rear wall portion 34*c*, at positions in the vicinity of end portions of the second through-hole 42 in the longitudinal direction, to prevent the connection plate 24 from coming out of the second through-hole 42, so that the pedal operating force is reliably transmitted to the output member 26 via the connection plate 24. Especially, in the present embodiment, the paired projections 48 are formed on the respective side portions of the connection plate 24, and hence the posture of the connection plate 24 is prevented from being noticeably changed, so that the pedal operating force is suitably transmitted to the output member 26 via the connection plate 24.

Figure 6:
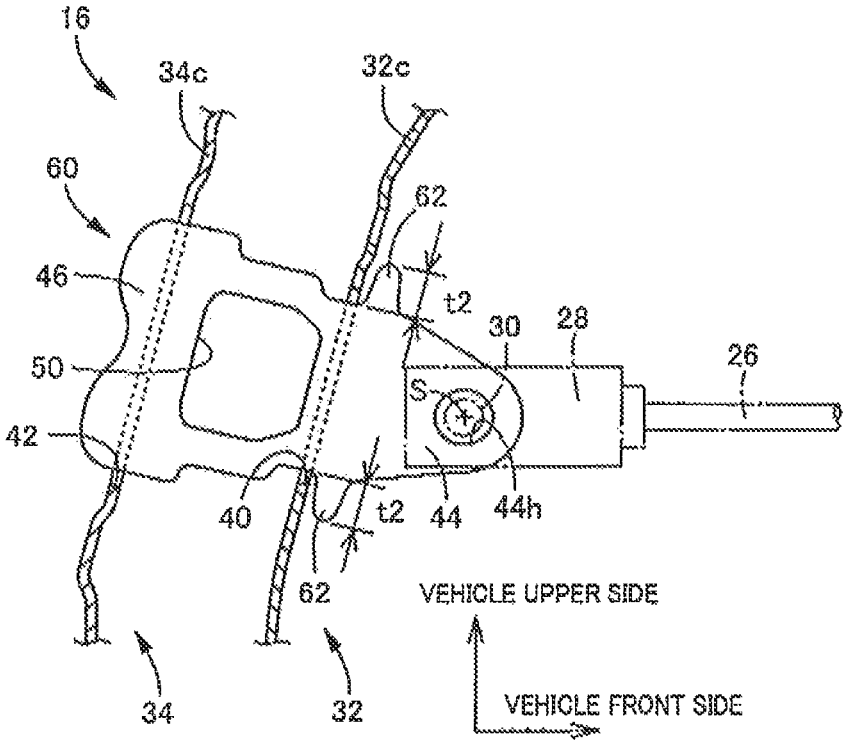
FIG. 6 is an explanatory view of another embodiment of the present invention, and is a cross sectional view corresponding to FIG. 4.

Note that, in the above-described embodiment, the projections 48 are formed at the portion of the connection plate 24, which is located in the hollow of the hollow pedal arm 16, but projections 62 may be formed on respective side portions of the connecting portion 44 as in a connection plate 60 illustrated in FIG. 6. That is, at the portion projecting outwardly from the first through-hole 40 and close to the front wall portion 32*c* of the front half 32, a pair of the projections 62 may be formed so as to project in the longitudinal direction of the first through-hole 40. A projecting dimension t2 of each of the projections 62 is larger than a clearance dimension between the first through-hole 40 and the connecting portion 44 (the length dimension of the first through-hole 40—a width dimension of the connecting portion 44). Thus, even when both the second welding portion W2 and the third welding portion W3 which fix the connection plate 60 to the hollow pedal arm 16 are peeled off, the projections 62 abut against an outer wall surface of the front wall portion 32*c*, at positions in the vicinity of end portions of the first through-hole 40 in the longitudinal direction to prevent the connection plate 60 from being hidden in the first through-hole 40, so that the pedal operating force is reliably transmitted to the output member 26 via the connection plate 60. Further, the paired projections 62 are formed on respective side portions of the connection plate 60, and hence a posture of the connection plate 60 is prevented from being noticeably changed, so that the pedal operating force is appropriately transmitted to the output member 26 via the connection plate 60. The projections 62 may be formed so as to come into contact with the front wall portion 32*c* of the front half 32 in a state where the connection plate 60 is fixed to the hollow pedal arm 16. Note that the connection plate 60 in FIG. 6 is different from the connection plate 24 only in the projections 62, and the other portions are substantially the same as those of the connection plate 24, and therefore denoted by the same reference symbols to omit description thereof.

While example embodiment of the invention has been described in detail with reference to the drawings, the example embodiment is merely one mode for carrying out the invention. The invention may be implemented in various modes achieved by making various changes and improvements based on the knowledge of a person skilled in the art.

NOMENCLATURE OF ELEMENTS

10: vehicle operation pedal apparatus 16: hollow pedal arm 24, 60: connection plate 26: output member 32: front half 32*a*, 32*b*: side end portion 32*c*: front wall portion 34: rear half 34*a*, 34*b*: side end portion 34*c*: rear wall portion 40: first through-hole 42: second through-hole 44: connecting portion 48, 62: projections S: connection axis W1, W2, W3: welding portion

The invention claimed is:

1. A vehicle operation pedal apparatus comprising:

an elongate hollow pedal arm disposed in an up-down direction of a vehicle and provided with a pedal sheet which is disposed at a lower end portion of the hollow pedal arm and which is to be depressed toward a front side of the vehicle, such that a pedal operating force applied to the hollow pedal arm is transmitted to an output member which is to be connected to the hollow pedal arm and which is to be pivotable relative to the hollow pedal arm; and a plate-shaped connection plate including a connecting portion which is to be connected to the output member and which is to be pivotable relative to the output member, the plate-shaped connection plate being fixed integrally with the hollow pedal arm, the hollow pedal arm being formed of a pair of a front half and a rear half each having a U-shaped section, which are two members split along an up-down longitudinal direction of the hollow pedal arm and located respectively on front and rear sides with respect to the vehicle, and the halves being combined with each other, such that the halves are jointed, at side end portions thereof located on respective sides in a width direction of the vehicle, to each other, with opening sides of the front half and rear half facing each other, thereby forming a hollow tubular shape;

the front half and the rear half having a slit-shaped first through-hole and a slit-shaped second through-hole, respectively; and the connection plate being passed through the hollow pedal arm in a front-rear direction of the vehicle through the first through-hole and the second through-hole.

2. The vehicle operation pedal apparatus according to claim 1, wherein the hollow pedal arm is obtained by combining the rear half and the front half with each other such that a pair of side end portions of the rear half are overlapped with and joined to outer sides of a pair of side end portions of the front half, respectively.

3. The vehicle operation pedal apparatus according to claim 1, wherein both end portions of the connection plate including the connecting portion projecting outwardly from the hollow pedal arm are fixed integrally with the hollow pedal arm by welding, respectively.

4. The vehicle operation pedal apparatus according to claim 1, wherein the connection plate is partially inserted into the first through-hole, and fixed integrally with the hollow pedal arm by welding in a state where the connecting portion is projected from the first through-hole toward the vehicle front side; and a pressing load for pushing the output member toward the vehicle front side is applied by the pedal operating force to the output member connected to the connection plate.

5. The vehicle operation pedal apparatus according to claim 4, wherein both end portions of the connection plate including the connecting portion projecting outwardly from the hollow pedal arm are fixed integrally with the hollow pedal arm by welding, respectively.

6. The vehicle operation pedal apparatus according to claim 5, wherein a projection projecting in a longitudinal direction of the second through-hole is formed at a portion of the connection plate, which is located in a hollow of the hollow pedal arm.

7. The vehicle operation pedal apparatus according to claim 5, wherein a projection projecting in a longitudinal direction of the first through-hole is formed at a portion of the connecting portion of the connection plate, which projects outwardly from the first through-hole.

* * * * *